US007389668B2

(12) United States Patent
Nakamura et al.

(10) Patent No.: US 7,389,668 B2
(45) Date of Patent: Jun. 24, 2008

(54) METAL MOLDING METHOD AND MACHINE, AND METAL MOLDED BODY

(75) Inventors: Katsuaki Nakamura, Fukuoka (JP); Zenji Horita, Fukuoka (JP); Koji Neishi, Fukuoka (JP); Michihiko Nakagaki, Munakata (JP); Kenji Kaneko, Fukuoka (JP)

(73) Assignee: Rinascimetalli Ltd., Fukuoka-shi (JP)

( * ) Notice: Subject to any disclaimer, the term of this patent is extended or adjusted under 35 U.S.C. 154(b) by 5 days.

(21) Appl. No.: 10/565,692

(22) PCT Filed: Jul. 21, 2004

(86) PCT No.: PCT/JP2004/010347

§ 371 (c)(1),
(2), (4) Date: Jun. 7, 2006

(87) PCT Pub. No.: WO2005/007317

PCT Pub. Date: Jan. 27, 2005

(65) Prior Publication Data

US 2006/0248936 A1 Nov. 9, 2006

(30) Foreign Application Priority Data

Jul. 22, 2003 (JP) ..... 2003-277329

(51) Int. Cl.
*B21C 23/04* (2006.01)

(52) U.S. Cl. ..... 72/264; 72/260; 72/353.2; 72/354.6; 72/370.01

(58) Field of Classification Search ..... 72/260, 72/262, 257, 264, 265, 268, 353.2, 353.6, 72/354.2, 354.6, 359, 360, 370.01, 370.03, 72/370.04, 370.1, 394, 398
See application file for complete search history.

(56) References Cited

U.S. PATENT DOCUMENTS

| | | | | |
|---|---|---|---|---|
| 3,286,502 | A * | 11/1966 | Maurice | 72/259 |
| 3,680,381 | A * | 8/1972 | Portal | 72/355.6 |
| 4,423,617 | A * | 1/1984 | Nippert | 72/356 |
| 5,119,663 | A * | 6/1992 | Bottger | 72/355.2 |
| 6,363,765 | B1 * | 4/2002 | Seok et al. | 72/253.1 |
| 6,370,930 | B1 * | 4/2002 | Lee et al. | 72/262 |
| 6,399,215 | B1 * | 6/2002 | Zhu et al. | 428/544 |

FOREIGN PATENT DOCUMENTS

| | | |
|---|---|---|
| JP | 51-92779 | 8/1976 |
| JP | 5-7922 | 1/1993 |
| JP | 8-1270 | 1/1996 |
| JP | 2000-271695 | 10/2000 |
| JP | 2002-96140 | 4/2002 |
| WO | 01/96039 | * 12/2001 |

* cited by examiner

*Primary Examiner*—Edward Tolan
(74) *Attorney, Agent, or Firm*—Jordan and Hamburg LLP

(57) ABSTRACT

The present invention provides a metal molding method, a metal molding machine and a metal molded body, wherein using a mold in which a molding space having a predetermined shape and a metal body lead-in space which is communicated with the molding space are formed, a metal body which is inserted into the metal body lead-in space is fed into the molding space by applying a predetermined pressure thus forming a molded product having a predetermined shape. Particularly, the metal body is deformed by shearing when the metal body is fed to the molding space from the metal body lead-in space thus turning the metal structure of the metal body into the finer grain structure.

20 Claims, 5 Drawing Sheets

METAL MOLDING METHOD AND MACHINE, AND METAL MOLDED BODY

This application is a 35 USC 371 of PCT/JP04/10347 filed Jul. 21, 2004.

BACKGROUND OF THE INVENTION

The present invention relates to a metal molding method which forms a metal molded body having a predetermined shape using a metal body, a metal molding machine and a metal molded body.

Conventionally, forging has been used as one of methods for forming a metal-made structure having a predetermined shape.

In this forging, using a mold having a molding surface which traces a desired outer surface, the metal body is drawn by hitting along the molding surface thus allowing the mold to have a predetermined shape.

In this manner, since the metal body is formed along the molding surface by hitting in forging, it is difficult to form the metal body into a relatively complicated shape. For example, to manufacture a cylindrical metal-made product by forging, as described in Japanese Patent Laid-open Hei5 (1993)-7922, a metal body having a cylindrical shape is preliminarily prepared and, then, this cylindrical metal body is forged to form a cylindrical body having a predetermined shape.

In this manner, when a molded body having a predetermined shape is formed by forging, it is necessary to preliminarily prepare a metal body having a shape which can be easily obtained thus giving rise to a drawback that a manufacturing cost is pushed up due to forming of the metal body to be forged.

Under such circumstances, inventors of the present invention have studied to reduce the manufacturing cost by reducing the dependency of the metal body to be forged on shape and to reduce the manufacturing cost by allowing parts having irregular shapes to be integrally molded, and have arrived at the present invention.

BRIEF SUMMARY OF THE INVENTION

In a metal molding method according to a first exemplary embodiment, a mold having a molding space with a predetermined shape and a metal body lead-in space communicating with the molding space are used to form a molded body with a predetermined shape. The molding is performed by supplying, under a predetermined pressure, a metal body which is inserted into the metal body lead-in space to the molding space. Accordingly, in the same manner as the plastic injection molding, it is possible to form a metal body into a molded body having a predetermined shape, and the dependency of the metal body on shape before molding can be reduced thus realizing the reduction of manufacturing cost.

The metal molding method according to a second exemplary embodiment is, in the metal molding method according to a first exemplary embodiment, characterized in that the metal body is deformed by shearing at the time of feeding the metal body into the molding space from the metal body lead-in space thus turning the metal structure of the metal body into the finer grain structure. Accordingly, along with the turning of the metal structure of the metal body into the finer grain structure, it is possible to feed the metal body which enhances the plasticity into the molding space and hence, molding of the metal body similar to injection molding can be realized.

Further, along with the turning of the metal structure of the metal body into the finer grain structure, it is possible to enhance strength of the metal body whereby functional properties can be enhanced.

The metal molding method according to a third exemplary embodiment is, in the metal molding method according to a first exemplary embodiment, characterized in that at least one of the metal body lead-in space and the molding space includes a bent portion which bents the fed metal body. Accordingly, in the bent portion, it is possible to turn the metal structure of the metal body into the finer grain structure by shearing deformation of the metal body which passes through the bent portion. Along with the turning of the metal structure into the finer grain structure, it is possible to feed the metal body which enhances the plasticity thereof to the molding space and hence, molding of the metal body similar to injection molding can be realized. Further, along with the turning of the metal structure of the metal body into the finer grain structure, it is possible to enhance the strength of the metal body whereby functional properties can be enhanced.

The metal molding method according to a fourth exemplary embodiment is, in the metal molding method according to a first exemplary embodiment, characterized in that a communicating region which is communicated with the metal body lead-in space and a molding region which molds the metal body which passes through the communicating region into a predetermined shape are formed in the molding space and, at the same time, the feeding direction of the metal body to the molding region from the communicating region and the feeding direction of the metal body in the metal body lead-in space are made different from each other. Accordingly, the metal body is deformed by shearing at the time of changing the feeding direction of the metal body and the metal structure of the metal body is turned into the finer grain structure by shearing deformation. Further, it is possible to feed the metal body whose plasticity is enhanced along with the turning of the metal structure into the finer grain structure into the molding space and hence, molding such as injection molding of the metal body can be realized. Further, along with the turning of the metal structure of the metal body into the finer grain structure, it is possible to enhance strength of the metal body whereby functional properties can be enhanced.

The metal molding method according to a fifth exemplary embodiment is, in the metal molding method according to a fourth exemplary embodiment, characterized in that the metal body which passes through the molding region is allowed to project to the outside of the mold, and the projecting portion is molded by pressing into a predetermined shape. Accordingly, it is possible to perform the dense-shaped molding by pressure molding. Further, since the molded mold body can be formed into an integral molded product, it is possible to enhance the strength of the molded product.

The metal molding method according to a sixth exemplary embodiment is, in the metal molding method according to a fourth exemplary embodiment, characterized in that the molding region is formed in an approximately cylindrical shape which extends using the communicating region as a proximal end thereof and, at the same time, a hole forming pin which extends toward the proximal end from a distal end of the molding region is arranged in the molding region, and a cylindrical portion is formed in a molded body. Accordingly, it is possible to form the cylindrical portion which is integrally connected with the metal body in the communicating region portion in a projecting manner thus forming the molded body having the integrally-formed cylindrical portion.

The metal molding method according to a seventh exemplary embodiment is, in the metal molding method according to a sixth exemplary embodiment, characterized in that a cylindrical collar which brings an inner peripheral surface thereof into slide contact with the hole forming pin and an outer peripheral surface thereof into slide contact with an inner peripheral surface of the mold in the molding region is mounted on the hole forming pin and, along with the feeding of the metal body into the molding region, a communicating-region-side end surface of the collar is gradually moved to a distal-end side of the molding region. Accordingly, the cylindrical portion can be formed while stably holding the hole forming pin which forms a hole in the cylindrical portion using the collar and hence, it is possible to enhance the accuracy of forming of the cylindrical portion.

The metal molding method according to an eighth exemplary embodiment is, in the metal molding method according to a seventh exemplary embodiment, characterized in that the collar is moved along the hole forming pin by a predetermined distance and, thereafter, the hole forming pin is pushed into the communicating region. Accordingly, it is possible to form the hole by the hole forming pin not only in the molding region but also in the communicating region.

The metal molding method according to a ninth exemplary embodiment is, in the metal molding method according to the eighth exemplary embodiment, characterized in that when the hole forming pin is pushed into the communicating region, a cylinder which supplies the metal body into the metal body lead-in space by pressing is retracted. Accordingly, a pressure necessary for pushing the hole forming pin into the communicating region of the hole forming pin is reduced thus lowering a load applied to the hole forming pin whereby it is possible to prevent the breakdown of the hole forming pin.

The metal molding method according to a tenth exemplary embodiment is, in the metal molding method according to any one of the first through ninth exemplary embodiments, characterized in that a plurality of metal body lead-in spaces are provided. Accordingly, the metal body can be fed into the molding space with a low load and, at the same time, the occurrence of irregular thickness of the metal body in the molding space can be suppressed.

A metal molding machine according to an eleventh exemplary embodiment includes a mold in which a molding space having a predetermined shape and a metal body lead-in space which are communicated with each other are formed, and a pressing means which feeds a metal body into the molding space from the metal body lead-in space by pressing the metal body which is inserted into the metal body lead-in space thus forming a molded body having a predetermined shape. Accordingly, it is possible to form the molded body by molding the metal body in a predetermined shape as in the case of the injection molding of plastic and hence, the dependency on shape of the metal body before molding can be decreased and hence, it is possible to provide a metal molding machine which can reduce a manufacturing cost.

The metal molding machine according to a twelfth exemplary embodiment is, in the metal molding machine according to an eleventh exemplary embodiment, characterized in that at least one of the metal body lead-in space and the molding space includes a shearing deforming means which deforms the metal body by shearing. Accordingly, it is possible to turn the metal structure of the metal body into the finer grain structure by deforming the metal body by shearing using the shearing deforming means and hence, along with the turning of the metal structure of the metal body into the finer grain structure, it is possible to feed the metal body which enhances the plasticity into the molding space whereby it is possible to provide a metal molding machine which can realize the molding of the metal body similar to injection molding. Further, along with the turning of the metal structure of the metal body into the finer grain structure, it is possible to enhance strength of the metal body thus providing a molded body which can enhance functional properties thereof.

The metal molding machine according to a thirteenth exemplary embodiment is, in the metal molding machine according to the twelfth exemplary embodiment, characterized in that the shearing deforming means is constituted of a bent portion which bents the fed metal body. Accordingly, it is possible to extremely easily deform the shearing deformation of the metal body.

The metal molding machine according to a fourteenth exemplary embodiment is, in the metal molding machine according to the eleventh exemplary embodiment, characterized in that a communicating region which is communicated with the metal body lead-in space and a molding region which molds the metal body which passes through the communicating region into a predetermined shape are formed in the molding space and, at the same time, the feeding direction of the metal body to the molding region from the communicating region and the feeding direction of the metal body in the metal body lead-in space are made different from each other. Accordingly, the metal body is deformed by shearing when the feeding direction of the metal body is changed along with the feeding of the metal body into the molding space from the metal body lead-in space and hence, it is possible to provide the molding machine which can turn the metal structure of the metal body into the finer grain structure by the shearing deformation. Then, it is possible to feed the metal body whose plasticity is enhanced along with the turning of the metal structure into the finer grain structure into the molding space and hence, molding such as injection molding of the metal body can be realized. Further, along with the turning of the metal structure of the metal body into the finer grain structure, it is possible to enhance strength of the metal body whereby functional properties can be enhanced.

The metal molding machine according to a fifteenth exemplary embodiment is, in the metal molding machine according to the fourteenth exemplary embodiment, characterized in that the metal molding machine includes a pressure molding means which allows the metal body which passes through the molding region to project to the outside of the mold and molds the projecting portion into a predetermined shape by pressing. Accordingly, it is possible to perform the dense-shaped molding by pressure molding using a pressure molding means. Further, it is also possible to provide the metal molding machine which can manufacture the integrally-molded molded body.

The metal molding machine according to a sixteenth exemplary embodiment is, in the metal molding machine according to the fourteenth exemplary embodiment, characterized in that the molding region is formed in an approximately cylindrical shape which extends using the communicating region as a proximal end thereof and, at the same time, a hole forming pin which extends toward the proximal end from a distal end of the molding region is formed in the molding region, and a cylindrical portion can be formed into a molded body. Accordingly, it is possible to provide the metal molding machine in which the cylindrical portion which is integrally connected with the metal body in the communicating region portion is formed in a projecting manner.

The metal molding machine according to a seventeenth exemplary embodiment is, in the metal molding machine according to the sixteenth exemplary embodiment, characterized in that a collar which brings an inner peripheral surface thereof into slide contact with the hole forming pin and an outer peripheral surface thereof into slide contact with an inner peripheral surface of the mold in the molding region is mounted on the hole forming pin and, the metal molding machine further includes a collar control means in which along with the feeding of the metal body into the molding region, a communicating-region-side end surface of the collar is gradually moved to a distal end side of the molding region. Accordingly, the cylindrical portion can be formed while stably holding the hole forming pin which forms a hole in the cylindrical portion using the collar and hence, it is possible to provide the metal molding machine which can enhance the accuracy in the formation of the cylindrical portion.

The metal molding machine according to an eighteenth first exemplary embodiment is, in the metal molding machine according to the seventeenth exemplary embodiment, characterized in that the metal molding machine includes a hole forming pin control means which moves the collar along the hole forming pin by a predetermined distance and, thereafter, pushes the hole forming pin into the communicating region. Accordingly, it is possible to provide the metal molding machine which can form the hole using the hole forming pin not only in the molding region but also in the communicating region.

The metal molding machine according to a nineteenth exemplary embodiment is, in the metal molding machine according to the eighteenth exemplary embodiment, characterized in that the metal molding machine includes a cylinder control means which retracts a cylinder which supplies the metal body into the metal body lead-in space by pressing when the hole forming pin is pushed into the communicating region using a hole forming pin control means. Accordingly, a pressure necessary for pushing the hole forming pin into the communicating region is reduced thus lowering a load applied to the hole forming pin whereby it is possible to provide the metal molding machine which can prevent the breakdown of the hole forming pin.

The metal molding machine according to a twentieth exemplary embodiment is, in the metal molding machine according to any one of eleventh to the nineteenth exemplary embodiments, characterized in that a plurality of metal body lead-in spaces are provided. Accordingly, the metal body can be fed into the molding space with a low load and, at the same time, it is possible to provide the metal molding machine which can suppress the occurrence of irregular thickness of the metal body in the molding space.

A metal molded body according to a twenty first exemplary embodiment is characterized in that using a mold in which a molding space having a predetermined shape and a metal body lead-in space which is communicated with the molding space are formed, a metal body which is inserted into the metal body lead-in space is fed into the molding space while applying a predetermined pressure to the metal body thus forming the metal molded body having a predetermined shape, wherein the metal structure of the metal body fed into the molding space is turned into the finer grain structure. Accordingly, it is possible to form the molded body having a predetermined shape by feeding the metal body whose plasticity is lowered due to the turning of the metal structure of the metal body into the finer grain structure into the molding space in the same manner as injection molding of plastic.

The metal molded body according to a twenty second exemplary embodiment is, in the metal molded body according to the twenty first exemplary embodiment, characterized in that a communicating region which is communicated with the metal body lead-in space and a molding region which molds the metal body which passes through the communicating region into a predetermined shape are formed in the molding space and, at the same time, the feeding direction of the metal body to the molding region from the communicating region and the feeding direction of the metal body in the metal body lead-in space are made different from each other. Accordingly, the metal body which reaches the molding region is deformed by shearing when the feeding direction of the metal body is changed along with the feeding of the metal body into the molding space from the metal body lead-in space, the metal structure of the metal body can be turned into the finer grain structure, and it is possible to form the metal molded body whose metal structure is turned into the finer grain structure at a low cost. Particularly, with respect to the metal molded body whose metal structure is turned into the finer grain structure, along with the turning of the metal structure of the metal body into the finer grain structure by the shearing deformation, it is possible to enhance strength of the metal body whereby it is possible to provide the metal molded body which can enhance the functional properties.

The metal molded body according to a twenty third exemplary embodiment is, in the metal molded body according to the twenty first exemplary embodiment, characterized in that the feeding direction of the metal body is bent in the communicating region. Accordingly, it is possible to deform the metal body by shearing extremely easily and efficiently thus providing the metal molded body which turns the metal structure into the finer grain structure at a low cost.

DETAILED DESCRIPTION OF THE INVENTION

Figure 1:
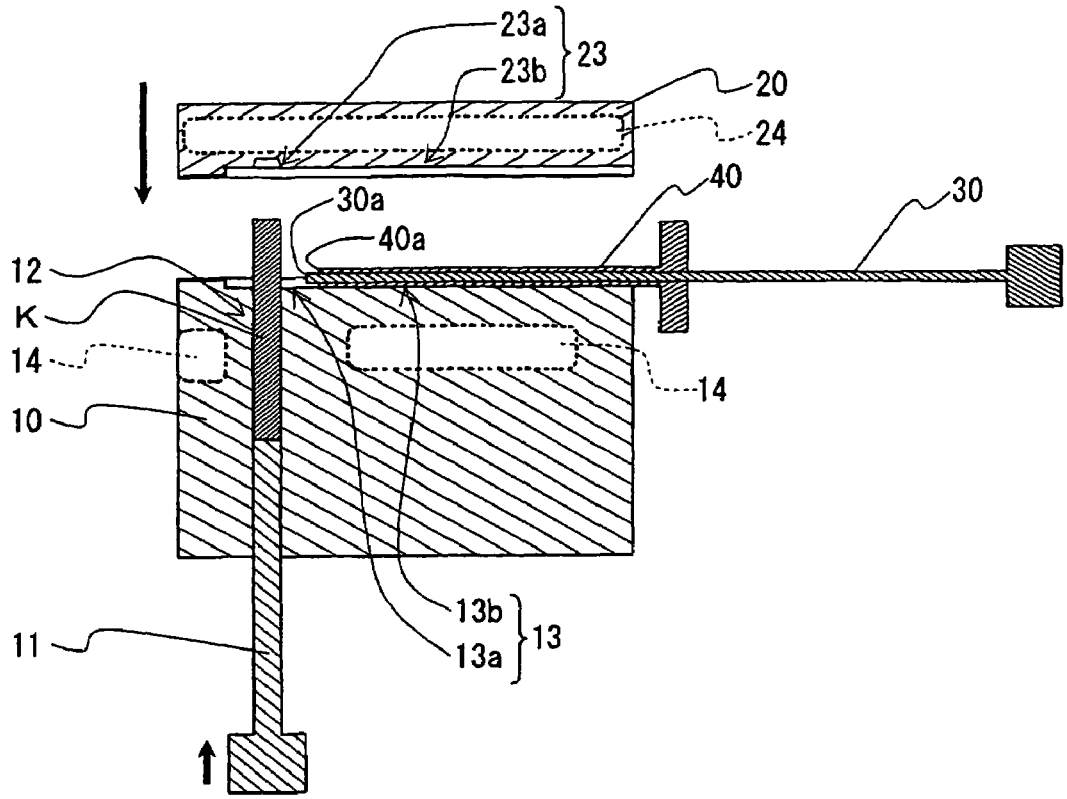
FIG. 1 is a schematic view showing a molding step according to a metal molding machine of the present invention.

In a metal molding method and a metal molding machine according to the present invention, by forming a metal body by molding using a mold in which a molding space having a predetermined shape and a metal body lead-in space which is communicated with the molding space, a metal molded body having a predetermined shape is formed.

Particularly, by inserting the metal body which constitutes the metal molded body into the metal body lead-in space and by feeding the metal body to the molding space by applying a predetermined pressure to the metal body, it is possible to form the metal molded body which molds the metal body in a predetermined shape as in the case of the injection molding of plastic.

That is, a communicating region which is communicated with the metal body lead-in space and a molding region which molds the metal body which passes through the communicating region into a predetermined shape are formed in the molding space and, at the same time, the feeding direction of the metal body to the molding region from the communicating region and the feeding direction of the metal body in the metal body lead-in space are made different from each other. Accordingly, the metal body is deformed by shearing at the time of changing the feeding direction of the metal body and the metal structure of the metal body is turned into the finer grain structure by a shearing stress which is applied to the metal body along with the shearing deformation, whereby the plasticity of the metal body is enhanced thus enabling the injection-molding-like molding.

Here, the deformation by shearing may be generated in either one of the molding space and the metal body lead-in space. By merely forming a bent portion which allows the bending of the metal body in the metal body lead-in space, it is possible to easily generate the deformation of the metal body by shearing by merely allowing the metal body to pass through the bent portion.

It is preferable that by arranging the metal body lead-in space in a state that the metal body lead-in space extends in the side-surface direction of the molding space, the metal body is bent in the communicating region of the molding space thus generating the deformation by shearing.

In this manner, by enabling the injection-molding-like molding, the dependency on shape of the metal body before molding can be decreased thus reducing a manufacturing cost.

Further, a plurality of metal body lead-in spaces is provided. By feeding the metal body into the molding space from a plurality of directions, it is possible to feed the metal body with a low applied voltage and, at the same time, the occurrence of irregular thickness of the metal body in the molding space can be suppressed.

Hereinafter, the embodiment of the present invention is explained in detail based on the drawings. This embodiment provides a metal molded body in which a cylindrical portion which is formed in a cylindrical shape and a proximal end portion which closes a hollow portion of the cylindrical portion in one end of the cylindrical portion are formed, wherein the cylindrical portion and the proximal end portion are integrally formed with each other.

FIG. 1 to FIG. 6 are overall schematic views showing molding steps according to a metal molding machine of this embodiment.

The metal molding machine of this embodiment is constituted of a first mold 10 which includes a lead-in passage 12 through which a metal body K is fed under a predetermined pressure using a cylinder 11, and a second mold 20 which is overlapped to the first mold 10 while being applied with a predetermined pressure and forms a molding space having a predetermined shape at a portion which is brought into contact with the first mold 10. A metal body lead-in space is constituted by the lead-in passage 12.

Particularly, in the metal molding machine of this embodiment, in the molding space, a communicating region which is communicated with the lead-in passage 12 is formed and, at the same time, a molding region having an approximately cylindrical shape which extends using such a communicating region as a proximal end thereof is formed. Further, a distal end of the molding region is communicated with an external space.

Further, in the molding region of the molding space, a rod-like hole forming pin 30 is inserted from the distal end to the proximal end of the molding region in an extending and retractable manner and, at the same time, a cylindrical collar 40 is extendably and retractably mounted on the hole forming pin 30 in a state that the collar 40 brings an inner peripheral surface thereof into slide contact with the hole forming pin 30 and an outer peripheral surface thereof into slide contact with an inner peripheral surfaces of the first mold 10 and the second mold 20.

Although not shown in the drawing, a hole-forming-pin extending and retracting control part which extends or retracts the hole forming pin 30 along the extending direction is connected to the hole forming pin 30.

Further, a collar extending and retracting control part which extends and retracts the collar 40 in a state that an outer peripheral surface of the collar 40 is brought into slide contact with the first mold 10 and the second mold 20 is connected to the collar 40. The collar extending and retracting control part constitutes a collar moving means.

With respect to the first mold 10, in an overlapping surface thereof which is overlapped to the second mold 20, a first molding recessed portion 13 which allows the formation of a molding space by pressing and overlapping the second mold 20 to the first mold 10 is formed.

The first molding recessed portion 13 is constituted of a first communicating region recessed portion 13*a* which constitutes a communicating region of the molding space and a first molding region recessed portion 13*b* which constitutes the molding region of the molding space.

In this embodiment, the first communicating region recessed portion 13*a* is formed into a recessed shape which allows the formation of a proximal end portion in a predetermined shape, while the first molding region recessed portion 13*b* is formed into a recessed shape having a semi-cylindrical peripheral shape which allows the formation of a cylindrical portion.

Further, one end of the lead-in passage 12 is communicably connected with the first communicating region recessed portion 13*a*. Particularly, in this embodiment, the lead-in passage 12 is provided substantially orthogonal to an overlapped surface of the first mold 10 with the second mold 20.

By providing the lead-in passage 12 in this manner, the metal body K which is fed from the lead-in passage 12 by the cylinder 11 with a predetermined pressure receives a shearing stress when the metal body K arrives at the first communicating region recessed portion 13*a* where the feeding direction changes.

In this embodiment, by arranging the lead-in passage 12 orthogonal to the overlapping surface of the first mold 10 with the second mold 20, the feeding direction of the metal body K in the lead-in passage 1 and the feeding direction of the metal body K from the communication range to the molding region are arranged approximately orthogonal to each other. However, such an arrangement is not limited to an approximately orthogonal state and it is sufficient that the feeding direction of the metal body K is bent at an angle which allows a shearing stress to be applied to the metal body K.

A heating device arranging space 14 for arranging a heating device is provided to the first mold 10 in place, and a heater (not shown in the drawing) which has a predetermined heat generating ability is arranged in the heating device arranging space 14 as the heating device.

The second mold 20 includes a second mold recessed portion 23 for forming the molding space when the second mold 20 is overlapped to the first mold 10 by pressing in an overlapping surface thereof with the first mold 10.

The second mold recessed portion 23 is constituted of a second communicating region recessed portion 23*a* which constitutes a communicating region of the molding space and a second molding region recessed portion 23*b* which constitutes a molding region of the molding space.

In this embodiment, the second communicating region recessed portion 23*a* is formed into a recessed shape which allows the formation of a proximal end portion in a predetermined shape, while the second molding region recessed portion 23*b* is formed into a recessed shape having a semi-cylindrical peripheral shape which allows the formation of a cylindrical portion.

Further, by overlapping the second mold 20 to the first mold 10, it is possible to constitute the communicating region having a predetermined shape in the molding space by the first communicating region recessed portion 13*a* and the second communicating region recessed portion 23*a*, while it is possible to integrally form the cylindrical portion and the proximal end portion by constituting a cylindrical molding region in the molding space by the first mold region recessed portion 13*b* and the second mold region recessed portion 23*b*.

Although not shown in the drawing, the second mold 20 is connected with a pressing device which serves to overlap the second mold 20 to the first mold 10 by pressing thus pressing the second mold 20 to the first mold 10 with a predetermined pressure.

Further, the second mold 20 is also provided with a heating device arranging space 24 for arranging a heating device in place, and a heater (not shown in the drawing) which possesses a predetermined heat generating ability is arranged in the heating device arranging space 24 as the heating device.

The hole forming pin 30 is a metal-made rod having a predetermined diameter, wherein a cylindrical molding region is formed between the first mold region recessed portion 13*b* and the second mold region recessed portion 23*b* by overlapping the second mold 20 to the first mold 10 and a distal end portion 30*a* of the hole forming pin 30 is inserted into the cylindrical molding region. Particularly, the hole forming pin 30 is extended or retracted in the molding region by a hole-forming-pin extending and retracting control part.

The collar 40 is a cylindrical metal body which forms a hollow portion for allowing the hole forming pin 30 to pass therethrough in a center portion thereof and has a size which allows the insertion thereof into a columnar molding region which is formed by the first molding region recessed portion 13*b* and the second molding region recessed portion 23*b*, wherein the collar 40 is slidably mounted on the hole forming pin 30 by allowing the hole forming pin 30 to be inserted into the hollow portion of the collar 40.

In this embodiment, the collar 40 has one end portion thereof extended outwardly from the molding region and has the extending portion connected with the collar extending and retracting control part and hence, the collar extending and retracting control part can perform an extending and retracting control of the collar 40 by bringing an outer peripheral surface of the collar 40 into slide contact with the first mold 10 and the second mold 20.

In molding the metal body K using the metal molding machine having the above-mentioned constitution, the metal molding K is molded by following operational steps. Here, although the warm working is adopted in this embodiment, the cold working or the hot working may be adopted.

(1) Mold Overlapping Step

First of all, the metal body K is inserted into the lead-in passage 12 of the first mold 10 and the metal mold K is heated to a predetermined temperature. Here, as shown in FIG. 1, the hole forming pin 30 and the collar 40 which is mounted on the hole forming pin 30 are positioned at a predetermined position in the first molding region recessed portion 13*b* of the first mold 10.

Here, the predetermined position of the hole forming pin 30 and the collar 40 in this embodiment, in case of the hole forming pin 30, implies a position where a distal end portion 30*a* of the hole forming pin 30 assumes a boundary portion between the first communicating region recessed portion 13*a* and the first molding region recessed portion 13*b*, while in case of the collar 40, a position where an end surface 40*a* of the collar 40 is retracted from the distal end portion 30*a* of the hole forming pin 30 by a predetermined size thus allowing the distal end portion 30*a* of the hole forming pin 30 to project.

By positioning the hole forming pin 30 in this manner, when the metal body K which is fed to the communicating region changes the feeding direction thereof as described later, it is possible to prevent the hole forming pin 30 from becoming an obstacle and hence, it is possible to smoothly feed the metal body K and, at the same time, it is possible to allow a shearing stress to be surely applied to the metal body K in the communicating region whereby the metal body K can obtain the finer metal structure.

When the metal body K arrives at a predetermined temperature, the cylinder 11 is activated as shown in FIG. 1 so as to extrude the metal body K from the lead-in passage 12 by a given size.

The cylinder 11 is connected with a cylinder extending and retracting control part not shown in the drawing and an extending and retracting control of the cylinder 11 is performed by the cylinder extending and retracting control part. The cylinder extending and retracting control part constitutes a cylinder control means.

Figure 2:
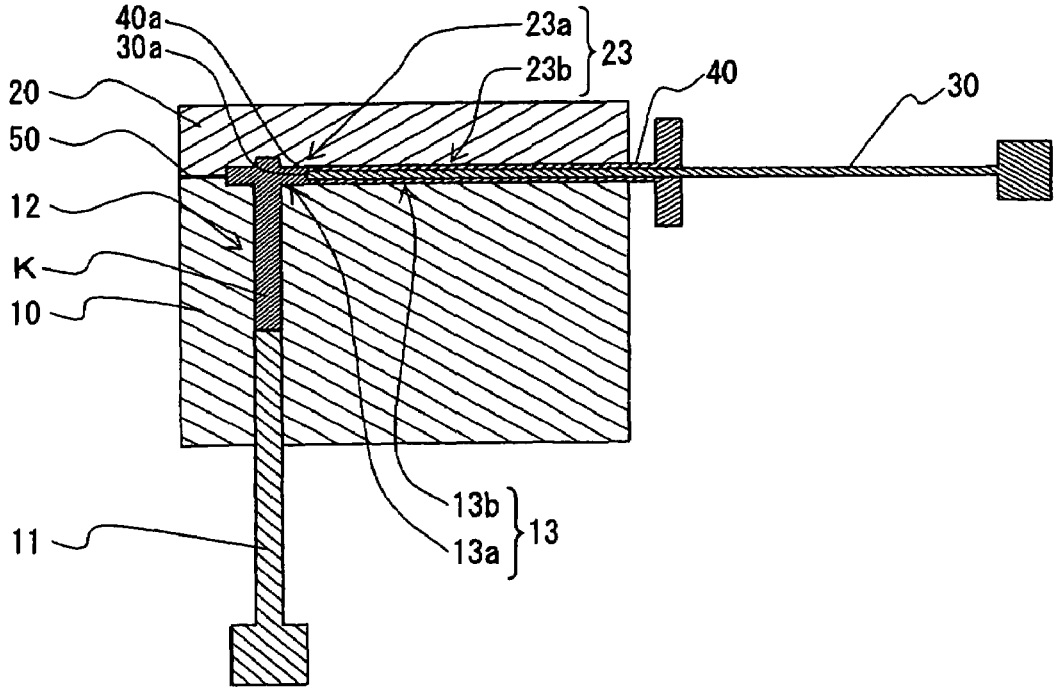
FIG. 2 is a schematic view showing a molding step according to the metal molding machine of the present invention.

After the metal body K is projected from the first mold 10 by the given size, the pressing device is activated so as to overlap the second mold 20 to the first mold 10 by pressing with a predetermined pressure thus, as shown in FIG. 2, performing initial molding of the metal body K using the first communicating region recessed portion 13*a* of the first mold 10 and the second communicating region recessed portion 23*a* of the second mold 20. In FIG. 2, numeral 50 indicates a buffer space for the metal body K.

Due to this initial molding, the metal body K is filled into the communicating region, and the metal body K is smoothly fed to the molding region by feeding the metal body K using the cylinder 11 described later.

(2) Cylindrical Portion Forming Step

Figure 3:
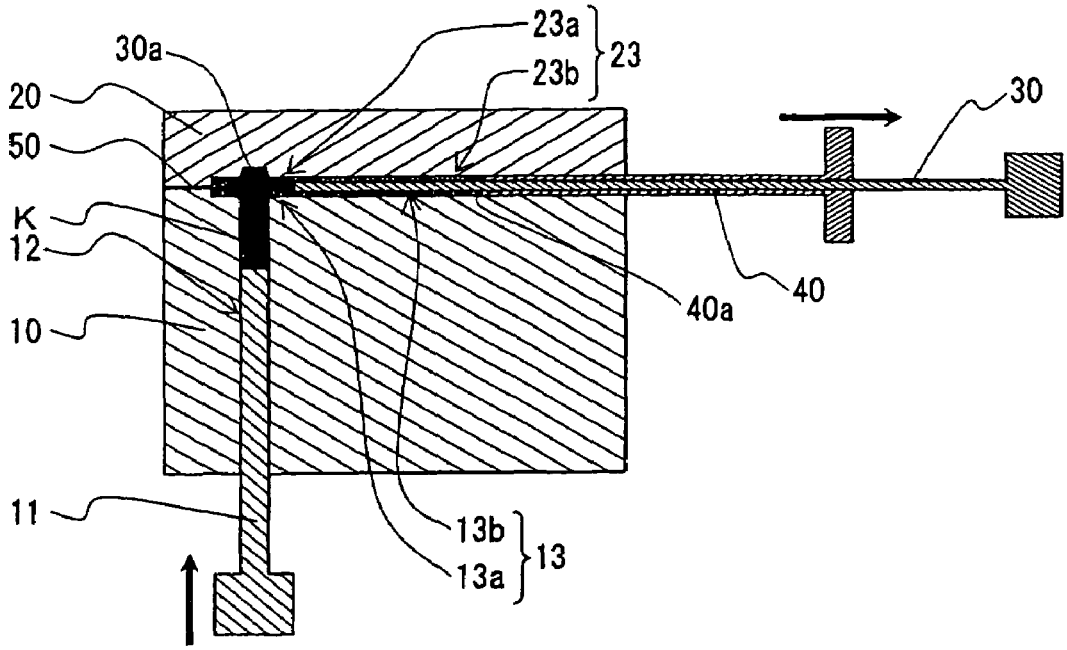
FIG. 3 is a schematic view showing a molding step according to the metal molding machine of the present invention.

After overlapping the first mold 10 and the second mold 20 to each other, as shown in FIG. 3, the cylinder 11 is advanced to feed the metal body K into the communicating region and, at the same time, an end surface 40*a* of the collar 40 on a communicating region side is gradually moved to a distal end side of the molding region so as to feed the metal body K into the molding space thus forming the metal body K in a cylindrical shape.

In this manner, by pressing the metal body K while supporting the hole forming pin 30 with the collar 40, it is possible to suppress the generation of distortion of the hole forming pin 30 attributed to the pressing insertion of the metal body K and hence, a cylindrical portion having an elongated size can be formed accurately.

Hollow Hole Extending Step

Figure 4:
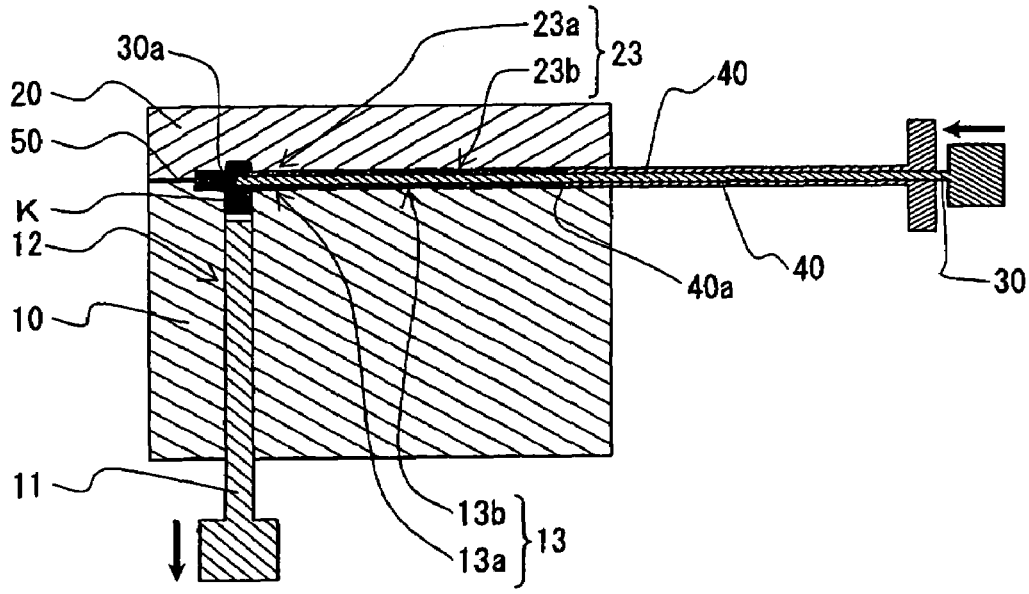
FIG. 4 is a schematic view showing a molding step according to the metal molding machine of the present invention.

The collar 40 is moved to the distal end side of the molding region by a predetermined distance thus forming the cylindrical portion having a predetermined length and, thereafter, as shown in FIG. 4, the cylinder 11 is retracted by a predetermined distance and, at the same time, the hole forming pin 30 is pushed into the communicating region thus also allowing a hollow hole to extend in the proximal end portion of the molding region.

Here, since the metal body K which is formed into the cylindrical portion in the molding region portion functions as a guide, it is possible to press the hole forming pin 30 into the communicating region in a stable manner.

Further, by retracting the cylinder 11 when the hole forming pin 30 is pushed into the communicating region, the metal body K which is pushed out from the communicating region along with the pushing-in of the hole forming pin 30 is pushed back to the space formed by the retraction of the cylinder 11 and hence, a resistance force which resists the pushing-in of the hole forming pin 30 can be alleviated thus easing the pushing-in of the hole forming pin 30.

In this manner, by extending the hollow hole to the proximal end portion, by forming a hole extending in the direction orthogonal to the hollow hole in the proximal end portion of a formed body K' which is formed by the metal body K, and by allowing the hole and the hollow hole to be communicated with each other, it is possible to turn the formed body K' into an elbow pipe.

(4) Removal-from-Mold Step

Figure 5:
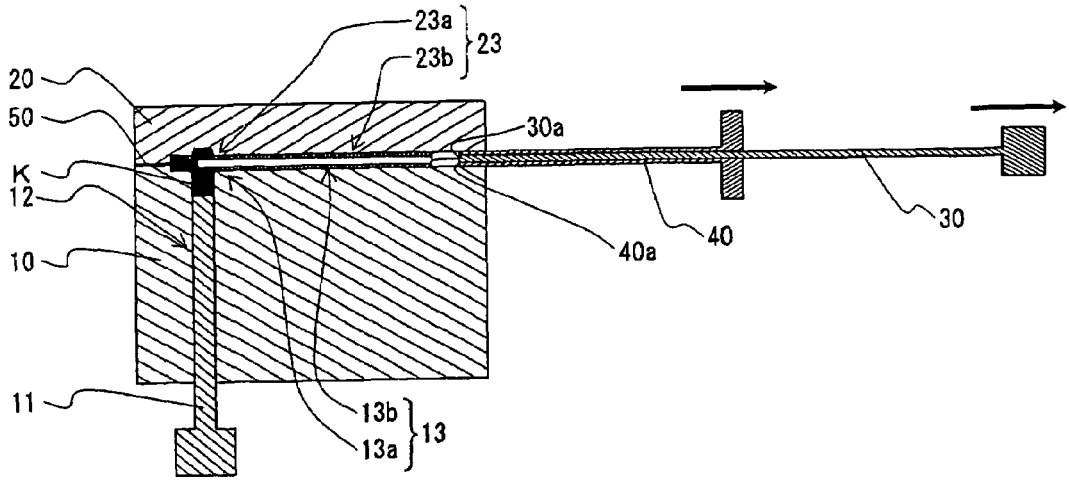
FIG. 5 is a schematic view showing a molding step according to the metal molding machine of the present invention.
Figure 6:
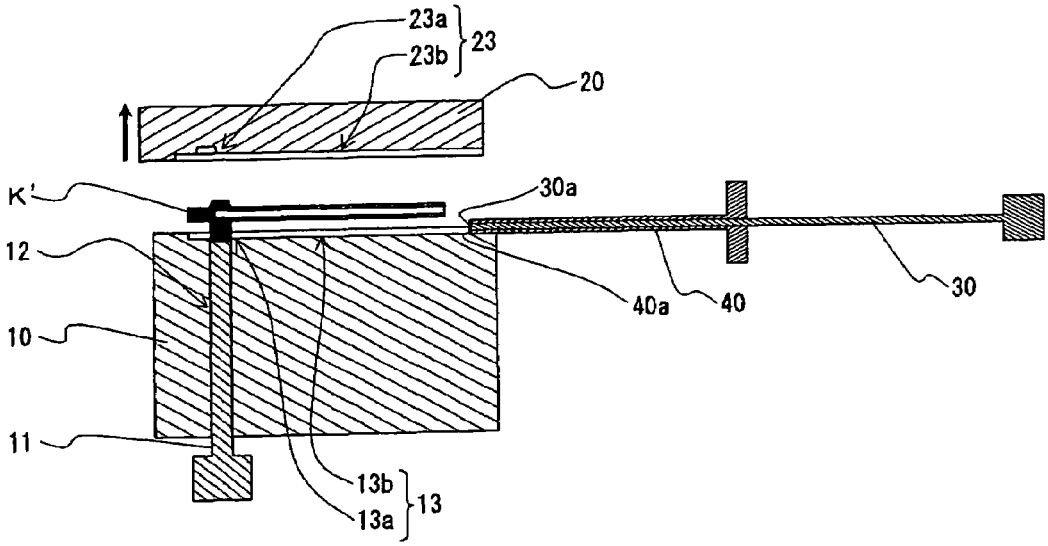
FIG. 6 is a schematic view showing a molding step according to the metal molding machine of the present invention.

After extending the hollow hole to the proximal end portion along with the pressing-in of the hole forming pin 30, as shown in FIG. 5, the hole forming pin 30 and the collar 40 are retracted thus removing the hole forming pin 30 from the cylindrical portion. Thereafter, as shown in FIG. 6, a second mold 20 is separated from a first mold 10 and, at the same time, the cylinder 11 is advanced thus pushing out the molded body K' formed in a predetermined shape whereby the removal of the molded body K' from the molds is completed.

In the molded body K' which is formed in this manner, the proximal end portion and the cylindrical portion can be integrally molded and hence, a welding operation which has been conventionally performed in forming a fitting which includes such a cylindrical portion is no more necessary thus realizing the reduction of a manufacturing cost and, at the same time, it is possible to provide a product which exhibits an extremely high dimensional accuracy.

Figure 7:
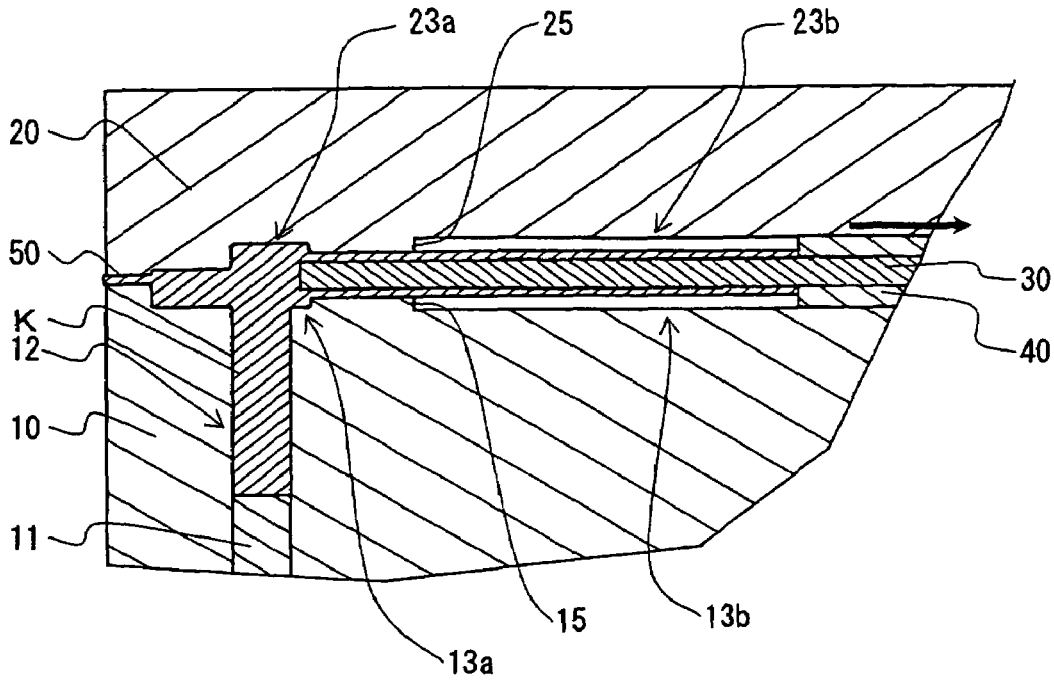
FIG. 7 is a schematic cross-sectional view of a metal molding machine according to another embodiment.

In forming a first molding-region recessed portion 13*b* and a second molding-region recessed portion 23*b* in the above-mentioned first mold 10 and the second mold 20, to be more specific, as shown in FIG. 7, the first molding-region recessed portion 13*b* and the second molding-region recessed portion 23*b* may be formed in conformity with a wall thickness of the collar 40, and a wall thickness of the cylindrical portion may be set to predetermined wall thicknesses in view of the hole forming pin 30, a first molding wall 15 which is formed between a first communicating region recessed portion 13*a* and the first molding-region recessed portion 13*b* of the first mold 10, and a second molding wall 25 which is formed between a second communicating region recessed portion 23*a* and the second molding-region recessed portion 23*b* of the second mold 20.

By forming the first molding wall 15 and the second molding wall 25 in this manner, it is possible to use a cylindrical body having a predetermined wall thickness as the collar 40 and hence, it is possible to support the hole forming pin 30 in a more stable manner.

Further, it is possible to prevent the metal body K which is formed into a cylindrical shape exceeding the first molding wall 15 and the second molding wall 25 and reaches the molding region from being brought into slide contact with the first mold 10 and the second mold 20. Accordingly, it is possible to suppress the generation of a large friction between the cylindrical metal body K and the first mold 10 and the second mold 20 and hence, the increase of feeding resistance of the metal body K attributed to the cylinder 11 can be suppressed.

Here, although not shown in the drawing, in a surface of the hole forming pin 30 and a surface of the collar 40, recessed portions are formed respectively, wherein the recessed portions serve to reduce a contact area between the hole forming pin 30 and the collar 40, a contact area between the hole forming pin 30 and a cylindrical portion formed of the metal body K, and a contact area between the collar 40 and the first mold 10 and the second mold 20, and also function as an air communication passage. Due to such a constitution, it is possible to smoothly perform the extending-and-retracting manipulation of the hole forming pin 30 and the extending-and-retracting manipulation of the collar 40.

By forming the above-mentioned cylindrical portion using the hole forming pin 30 on which the collar 40 is mounted as in the case of this embodiment, it is possible to suppress the generation of the deformation such as deflection of the hole forming pin 30 along with the feeding of the metal body K into the molding region thus enabling the accurate formation of the elongated cylindrical portion.

The formation of a hole portion using a hole forming pin 30 has been performed conventionally and, assuming a hole diameter of the hole portion as d and a length of the hole portion as l, the hole portion having a l/d value of approximately 3.0 has existed. However, by mounting the collar 40 on the hole forming pin 30 and by changing the projecting length of the hole forming pin 30 by moving the collar 40 as mentioned above, it is possible to form the cylindrical portion having the l/d value of 10 or more.

In the above-mentioned embodiment, by adjusting various conditions such as a heating temperature and a feeding pressure in conformity with properties of metal of the using metal body K, it is possible to use various kinds of metals as a material of the metal body K. Particularly, when soft aluminum is used as the material of the metal body K, it is possible to perform the above-mentioned molding by cold working without operating heaters which are mounted on the first molding wall 15 and the second molding wall 25.

Particularly, when the molding is performed using the above-mentioned molding method and metal molding machine by cold working, it is also possible to adjust the crystalline azimuths of the formed cylindrical metal body portion and hence, it is possible to enhance the functions of the molded product including the enhancement of the resistance to bending, for example.

Further, although the above-mentioned metal molding machine is configured such that the metal body K which is fed from the lead-in passage 12 is bent in the communicating region, a bent portion having a desired angle may be formed in a midst portion of the lead-in passage 12.

Figure 8:
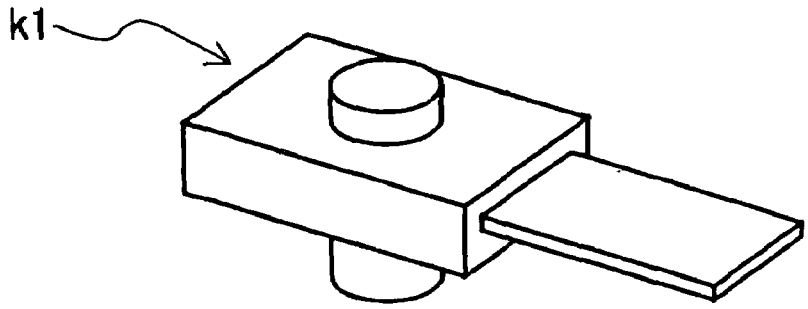
FIG. 8 is an explanatory view of a metal molded body of another embodiment.

Further, in the metal molding machine of the above-mentioned embodiment, the cylindrical portion is formed in the molding region. However, as another embodiment, as in a case of the metal molded body k1 shown in FIG. 8, a molded portion having a metal-plate-like shape having a predetermined thickness may be molded in a molding region.

Figure 10:
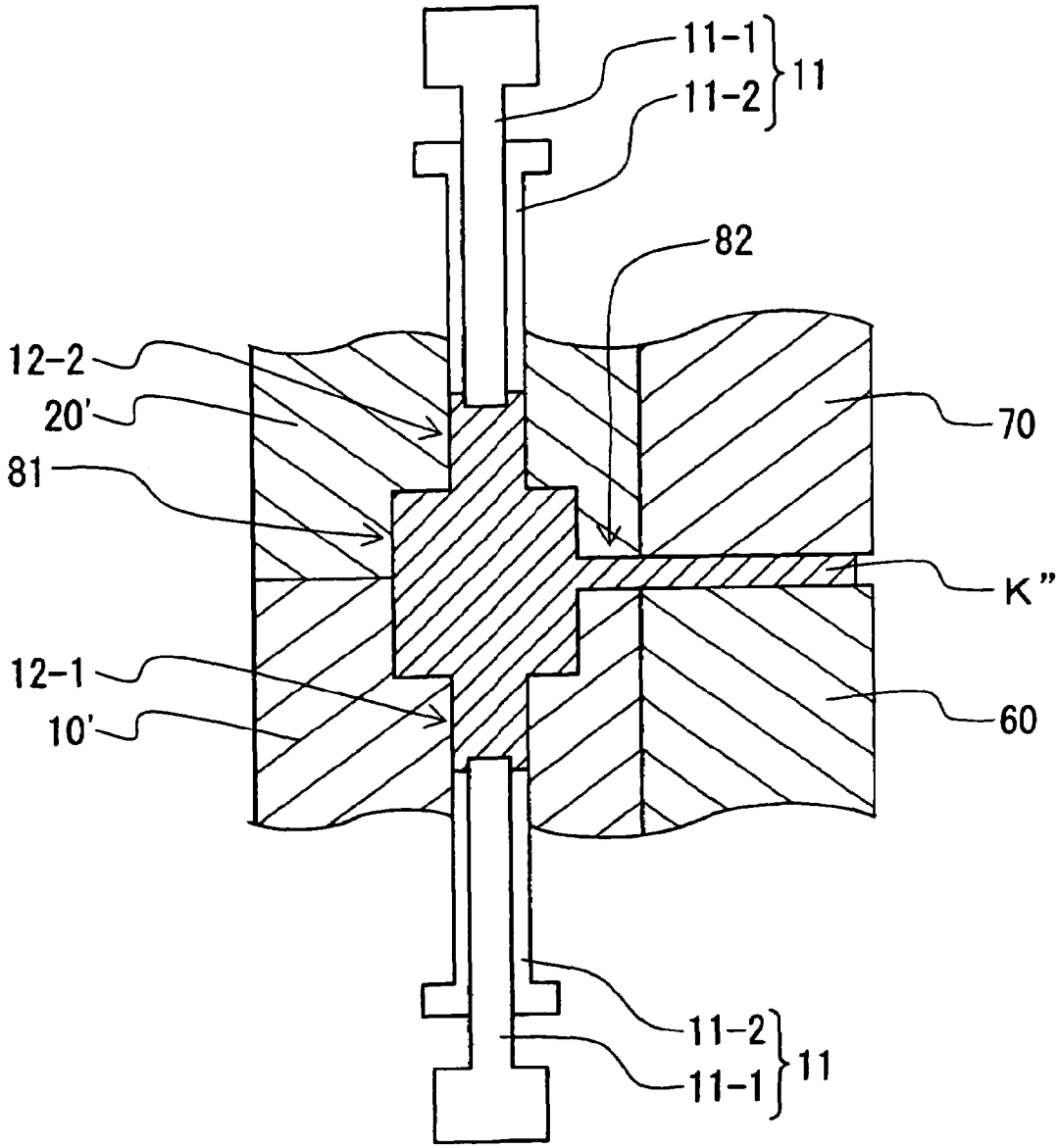
FIG. 10 is a schematic cross-sectional view of a metal molding machine according to another embodiment.

In this case, the plate-like molded portion may be formed in a metal plate shape having the predetermined thickness in the molding regions of the first mold 10 and the second mold 20 and, thereafter, may be projected into an outer space (see FIG. 10).

Figure 9:
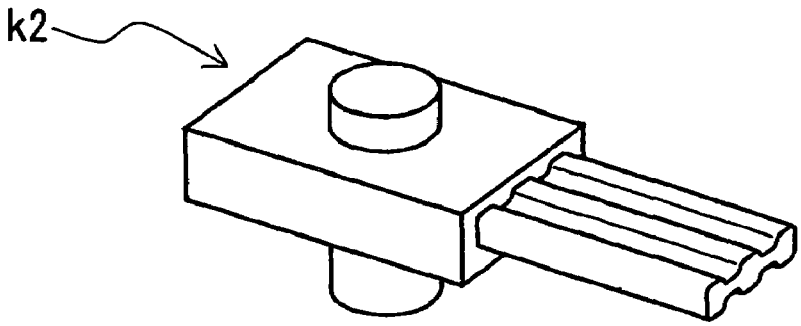
FIG. 9 is an explanatory view of a metal molded body of another embodiment.

That is, by adjusting an opening shape of the communicating portion leading from the molding region to the outer space, it is possible to form a metal molded body having a suitable cross-sectional shape. For example, as in the case of a metal molded body k2 shown in FIG. 9, in a molding region, thick-wall portions and thin-wall portions are molded in a metal-plate-like shape.

Further, as shown in FIG. 10 which is a schematic cross-sectional view, a metal molding machine includes a pressure molding means which is constituted of a first press mold 60 and a second press mold 70 for performing the pressure molding of a metal body K" which is projected to an outer space from a molding region 82 formed by a first mold 10' and a second mold 20', wherein the projecting portion of the metal body K" is pressure-molded by the first press mold 60 and the second press mold 70 thus being formed into a predetermined shape.

In this manner, it is possible to provide the metal molding machine which can form the metal molded body having a more complicated shape by pressure-molding the metal body into a predetermined shape using the pressure molding means. Further, since the formed metal molded body is an integral molded product, it is possible to further increase the strength of the metal molded body.

Particularly, when necessary, the projecting portion of the metal body K" may be formed by punching using the first press mold 60 and the second press mold 70. Further, a suitable working may be performed to obtain a desired shape or a property.

As shown in FIG. 10, numeral 12-1 indicates a first lead-in passage formed in the first mold 10', numeral 12-2 indicates a second lead-in passage formed in the second mold 20', the metal body K" is fed to a communicating region 81 from the first lead-in passage 12-1 and the second lead-in passage 12-2, and the metal body K" is fed to the molding region 82 from the communicating region 81.

By feeding the metal body K" into the molding space using a plurality of lead-in passages, it is possible to provide the metal molding machine which can feed the metal body K" with a low load and, at the same time, can suppress the generation of the irregular wall thickness of the metal body K" in the molding region 82.

In FIG. 10, although the lead-in passage for allowing the lead-in of the metal body K" is constituted of a first lead-in passage 12-1 and a second lead-in passage 12-2, three or more lead-in passages may be provided and, further, across-sectional shape and a cross-sectional area of the lead-in passages, a feeding speed of the metal body K", feeding timing of the metal body K" and the like may be adjusted.

Further, the cylinders 11 which feed the metal body K" by pressing in the first lead-in passage 12-1 and a second lead-in passage 12-2 may be constituted of a first columnar cylinder 11-1 and a second cylindrical cylinder 11-2 which is slidably mounted on the first cylinder 11-1, and the first cylinder 11-1 and the second cylinder 11-2 are separately subjected to extending-and-retracting control.

Particularly, when the metal body K" is fed by advancing the first cylinder 11-1 relative to the second cylinder 11-2, it is possible to reduce the influence such as the friction of the metal body K" when the metal body K" is brought into contact with inner peripheral surfaces of the first lead-in passage 12-1 and the second lead-in passage 12-2 and hence, it is possible to smoothly feed the metal body K into the molding space.

The present invention provides the metal molded body which is the metal molded product formed by forging and having a relatively complicated shape and allows the formation of the product which is usually constituted of a plurality of parts by integral molding. Further, the present invention can also manufacture the metal molded body at a low cost.

The invention claimed is:

1. A metal molding method for forming a metal body in a predetermined shape with a mold, the mold comprised of a metal body lead-in space, a molding space having a communicating region that communicates with the metal body lead-in space, and a molding region extending from the communicating region, the communicating region being at a proximal end of the molding region, a hole forming pin extending toward the proximal end from a distal end of the molding region, and a cylindrical collar having an inner peripheral surface in sliding contact with the hole forming pin and an outer peripheral surface thereof being in sliding contact with an inner peripheral surface of the mold in the molding region, the method comprising the steps of:

inserting the metal body into the metal body lead-in space of the mold;

feeding the metal body into the molding space of the mold under a predetermined pressure; and forming the metal body by moving a communicating-region-side end surface of the collar to a distal end side of the molding region along with the feeding of the metal body into the molding region.

2. The metal molding method according to claim 1, further comprising a step of deforming the metal body by shearing thereby transforming a metal structure of the metal body into a finer grain structure, wherein a feeding direction of the metal body into the molding region from the communicating region is different from an inserting direction of the metal body into the metal body lead-in space in the mold.

3. The metal molding method according to claim 1, further comprising a step of bending the metal body by feeding the metal body through a bent portion of the mold thereby transforming the metal structure of the metal body, wherein the bent portion is in at least one of the metal body lead-in space and the molding space.

4. The metal molding method according to claim 1, further comprising projecting the metal body to an outside of the mold after passing the metal body through the molding region, thereby extruding a projecting portion into a predetermined shape.

5. The metal molding method according to claim 1, further comprising moving the collar along the hole forming pin by a predetermined distance and, thereafter, pressing the hole forming pin into the communicating region.

6. The metal molding method according to claim 5, wherein the method further comprises a step of retracting a cylinder for feeding the metal body into the metal body lead-in space by pressing the hole forming pin into the communicating region.

7. The metal molding method according to claim 1, wherein the metal body is inserted into and fed from a plurality of metal body lead-in spaces, the mold further comprised of the plurality of metal body lead-in spaces which communicate with each other by way of the communicating region, and each of the plurality of metal body lead-in spaces face another of the metal body lead-in spaces in an opposed manner.

8. The metal molding method according to claim 7, wherein the feeding is performed on the metal body by separately controlling the extension and retraction of a first columnar cylinder and a second cylindrical cylinder, wherein a cylinder is comprised of the first columnar cylinder and the second cylindrical cylinder, the second cylindrical cylinder being slidably mounted in the first columnar cylinder.

9. The metal molded body formed by the metal molding method of claim 1.

10. The metal molded body formed by the metal molding method of claim 3.

11. The metal molding method according to claim 1, wherein the method further comprises a step of heating the metal body inserted into the metal body lead-in space by a heating device.

12. A metal molding machine comprising:

a mold comprised of a molding space and a metal body lead-in space which are in communication with each other;

a pressing means for pressing a metal body inserted into the metal body lead-in space and for feeding the metal body into the molding space from the metal body lead-in space, wherein the molding space is formed of a communicating region in communication with the metal body lead-in space and a molding region forming the metal body passing through the communicating region into a predetermined shape, the molding region extends from the communicating region, the communicating region being at a proximal end of the molding region, a hole forming pin extending toward the proximal end from a distal end of the molding region is formed in the molding region, a cylindrical collar having an inner peripheral surface in sliding contact with the hole forming pin and an outer peripheral surface in sliding contact with an inner peripheral surface of the mold is mounted on the hole forming pin, and the metal molding machine further includes a collar control means for gradually moving a communicating-region-side end surface of the collar to a distal end side of the molding region along with the feeding of the metal body into the molding region.

13. A metal molding machine according to claim 12, wherein at least one of the metal body lead-in space and the molding space includes a shearing deforming means which deforms the metal body by shearing.

14. A metal molding machine according to claim 13, wherein the shearing deforming means is constituted of a bent portion which bends the fed metal body.

15. The metal molding machine according to claim 12, wherein the metal molding machine includes a pressure molding means which allows the metal body that passes through the molding region to project to the outside of the mold and molds a projecting portion into a predetermined shape by pressing.

16. The metal molding machine according to claim 12, wherein the metal molding machine includes a hole forming pin control means which moves the collar along the hole forming pin by a predetermined distance and, thereafter, pushes the hole forming pin into the communicating region.

17. The metal molding machine according to claim 12, the metal molding machine further comprising a cylinder control means that retracts a cylinder which supplies the metal body into the metal body lead-in space by pressing when the hole forming pin is pushed into the communicating region using the hole forming pin control means.

18. The metal molding machine according to claim 12, the machine further comprising a plurality of metal body lead-in spaces, wherein each of the plurality of metal body lead-in spaces face another of the metal body lead-in spaces in an opposed manner and the metal body lead-in spaces communicate with each other by way of the communicating region.

19. The metal molding machine according to claim 18, further comprising cylinders that feed the metal body into the plurality of lead-in spaces, wherein each cylinder is comprised of a first columnar cylinder and a second cylindrical cylinder, the second cylindrical cylinder being slidably mounted in the first columnar cylinder, and extension and retraction of the first cylinder and the second cylinder are separately controlled.

20. The metal molding according to claim 12, further comprising a heating device in sufficient proximity to the lead-in passage to heat the metal body inserted into the metal body lead-in space.

* * * * *